US007150057B1

(12) United States Patent
Santiago et al.

(10) Patent No.: US 7,150,057 B1
(45) Date of Patent: Dec. 19, 2006

(54) LOWER LEG AND FOOT PILLOW

(76) Inventors: Lourdes Baluyot Santiago, 8596 Roosevelt Ave., Midway City, CA (US) 92655; Loreto Ganzon Santiago, 8596 Roosevelt Ave., Midway City, CA (US) 92655

( * ) Notice: Subject to any disclaimer, the term of this patent is extended or adjusted under 35 U.S.C. 154(b) by 0 days.

(21) Appl. No.: 10/959,274

(22) Filed: Oct. 5, 2004

Related U.S. Application Data

(60) Provisional application No. 60/508,827, filed on Oct. 4, 2003.

(51) Int. Cl.
*A47C 20/02* (2006.01)

(52) U.S. Cl. ..... 5/648; 5/632; 128/882

(58) Field of Classification Search ..... 5/648, 5/651, 630, 632, 633; 128/882
See application file for complete search history.

(56) References Cited

U.S. PATENT DOCUMENTS 3,003,815 A * 10/1961 Zinn ..... 297/118
3,308,489 A * 3/1967 Winkler ..... 5/648
3,901,228 A 8/1975 Brown
3,931,654 A 1/1976 Spann
3,946,451 A 3/1976 Spann
5,097,553 A * 3/1992 Boland ..... 5/648
5,134,739 A 8/1992 Gaffe et al.
5,173,979 A * 12/1992 Nennhaus ..... 5/648
5,216,771 A 6/1993 Hoff
5,398,354 A 3/1995 Balonick et al.
5,477,866 A 12/1995 Davenport
5,581,831 A * 12/1996 Xiang ..... 5/636
5,746,218 A 5/1998 Edge
5,833,708 A * 11/1998 Czaplak ..... 606/237
6,182,314 B1 2/2001 Frydman
6,578,218 B1 6/2003 Wassilefsky
6,634,045 B1 * 10/2003 DuDonis et al. ..... 5/648
2002/0088057 A1 7/2002 Wassilefsky
2002/0095729 A1 7/2002 Waters

* cited by examiner

*Primary Examiner*—Michael Trettel

(57) ABSTRACT

A pillow approximately like the letter P in a prone position with a substantially flat or even top or upper surface that upwardly underlies the lower legs, beginning from the calves towards the heels, of the supine user to relieve stress or leg fatigue from long hours of work, shopping, standing or walking, to improve blood circulation and to help prevent varicose veins. It is made of spongy or resilient material, and covered by an inner overlay as a lining and a replaceable outer outlay as a pillowcase. It is intended for use at home, office or any room or place with adequate space.

5 Claims, 6 Drawing Sheets

LOWER LEG AND FOOT PILLOW

CROSS REFERENCE TO RELATED APPLICATION

This is a non-provisional patent application which claims the benefit of Provisional Patent Application Ser. No. 60/508827 filed 2003 Oct. 4 by the present inventors.

BACKGROUND OF THE INVENTION

1. Field of Invention

The present invention relates to a leg and foot support used for therapeutic purposes, and, more particularly, to a lower leg and foot pillow which is placed under the calf and heel of both legs at the same time of a person reclining or lying supinely thereby elevating the lower legs and feet to provide relief to mind, body and well-being from stress, tension, and fatigue brought on by tired, strained or exhausted legs from standing, walking, working, shopping or other activity for long hours, to improve blood circulation and to help prevent varicose veins.

BACKGROUND OF THE INVENTION

2. Prior Art

Generally, prior patents and patent applications disclose leg and/or foot pillows which do not serve the same purpose nor give the same benefits as the present invention, and whose structure or configuration and theory of operation as to place, manner, time, duration of use, and user and user's condition, are in direct contrast with those of the present invention in many ways. Examples of prior patents include the following:

U.S. Pat. No. 3,901,228 discloses a therapeutic foot rest for not for normal persons but patients, and comprises a resilient foam boot having a base and upstanding side walls defining a cavity for receiving a patient's foot and holding the foot in an upright position, the end wall opposing the sole of the patient's foot being resiliently compressable against the footboard of the patient's bed to enable therapeutic exercise.

U.S. Pat. No. 3,931,654 discloses a Leg Positioner as a device for positioning and supporting the lower leg ankle and foot not of a normal person lying supinely on his or her back, but a patient as a unit while lying on his or her side during periods of extended rest, structured so as to enable the patient to lie on his side with the uppermost leg portion being positioned perpendicularly to the lower leg position which is positioned perpendicularly to the foot.

U.S. Pat. No. 3,946,451 discloses a Limb Support, made from a block of polyurethane foam having resilient characteristics, which has a continuous open topped arcuate groove extending longitudinally along the length of the block for receiving, cradling and resiliently gripping the limb not of a normal person, but of a hospitalized patient to avoid rotation of the limb supported thereby to prevent the formation of decubitus ulcers or bedsores on the heel.

U.S. Pat. No. 5,134,739 discloses a pillow for persons required to remain in supine position for an extended period of time.

U.S. Pat. No. 5,216,771 discloses a pillow with an hourglass shape for placing between the legs of an individual when lying on his or her side to provide for proper adjustment of the spine, hips and knees.

U.S. Pat. No. 5,398,354 discloses a Heel Pillow Mattress intended for use in a healthcare facility to prevent creation of sores.

U.S. Pat. No. 5,477,866 discloses a pillow for patients, comprising a first support arm rising to a first height, a second support arm rising to a second height and a support channel located therebetween, and used as a medical appliance in the treatment of multiple sclerosis and broken limbs and prevention of lateral and rotational foot movement to aid and shorten the healing process.

U.S. Pat. No. 5,746,218 discloses a nocturnal therapeutic pillow with a generally upwardly sloping and generally downwardly sloping base for keeping a person's legs together during sleep, that is, the pillow is nocturnally placeable between a user's legs, while the user is lying on his side and remains so positioned throughout the sleep cycle, to prevent stress leading to back pain or its aggravation during sleep.

U.S. Pat. No. 6,182,314 discloses a pillow as a device to provide orthopedic support to minimize spinal stress during sleep, by having leg clasps to securely engage the inner thighs of an individual in a side-lying position, or by positioning the pillow under the legs while an individual is in the lying position.

U.S. Pat. No. 6,578,218 discloses a pillow with a butterfly structure, with two cushions pivotably interconnected, with a flat inner surface and a curved contoured surface, used to support and align a person's head, to separate the person's legs, and elevate the upper leg for proper alignment with person's back.

U.S. patent application Publication No. 2002/0095729 A1 relates to an Original Foot Free Pillow that the user does not rest his foot on or against, but rather rests his foot near the pillow. The pillow raises the bed sheet and comforter several inches forming an air gap near the user's feet. This prevents the user sleeping in a bed with tight sheets from having a hard time turning over and moving due to constriction around the feet.

U.S. Pat. No. 5,097,553 discloses a leg support specifically for the relief of back pain, which has (a) two curved peaks on its upper surface, one for the knees and one for the heels and a gradual depression with an undulating surface between said peaks for calf support; (b) an inclined front surface with a length sufficient to engage the buttocks and rear thighs of the user so that the thighs are at a small angle from the vertical; (c) a horizontal top surface to support the user's leg between the knee and the foot; (d) a handle attached to the back surface to allow carrying the invention; (e) a one-inch pad to support the torso toward the already inclined thighs. The invention permits the user to perform modified sit-ups moving the torso toward the already inclined thighs. This invention comes in two pieces and two parts: (a) a main support unit to support the lower buttocks, thighs, knees, calves and feet; and (b) a one-inch mat. This invention is structured totally differently from the invention subject of instant application. The invention supports the user's buttocks and rear thighs unlike the invention subject of this application. The manner the invention supports the user's lower legs is different from the way the invention subject of instant application does.

U.S. Pat. No. 5,173,979 discloses an inflatable cushion apparatus which maintains a user's lower leg, ankle and foot in an elevated and horizontal position relative to the user's head and upper body, and which has an angled front wall to support the user's upper leg in an inclined position. It is formed as an envelope portion with a plurality of walls.

U.S. Pat. No. 5,581,831 discloses an ergonomic pillow which has stepped portions descending from the rear to the front thereof. The head of the supine sleeping person is supported on the upper stepped portion, the neck is supported on the elongated support member and the shoulders are supported on the middle and lower stepped portions. The invention is also usable for a person sleeping sideways. Its object is to promote shortening and relaxation of the muscles on the back of the neck and shoulders.

U.S. Pat. No. 5,833,708 discloses a method for lumbar spine disc flexion for the benefit of patients, and has a horizontal seat to receive the patient's buttocks, a curved surface to support the posterior knees of a user, and a downwardly sloping surface to support the posterior calves of the user. The invention supports the back of a patient when seated on the seat. Its object is to address or minimize the causes of low back pain and sciatica, and to improve flexion of the intervertebral discs of the lumbar spine.

U.S. Pat. No. 6,634,045 discloses a heel elevator cushion applied in treating bedridden patients with heel or foot pressure ulcers, in the treatment of persons after orthopedic surgery, and in recovery from venous surgery. It has bolsters or palisades on either side of the cushion to prevent the legs from falling from the bed. Its width approximates the width of a bed. Its length from front end to the back end approximates the length of a patient's leg from knee to Achilles tendon. It has a cover comprised of water-resistant elastomer material.

None of the prior art devices have the characteristics of the present invention. None of the patents, either taken singly or in combination, disclose the unique construction and operation of the instant invention. All of the pillows heretofore known suffer a number of disadvantages such as:

(a) their use is restricted to or they are available only in hospitals and other healthcare institutions and facilities;
(b) their use is restricted or available only to patients;
(c) their use requires long durations of time, e.g. extended bedrest;
(d) they are bulky, expensive, and cumbersome to use;
(e) they are beneficial only when used for extended periods of time required for healing;
(f) they are for nocturnal use or are used during sleep only.
(g) they cannot be flipped over and used on either side;
(h) their construction is complex and takes too much labor;
(i) in its open position, the Leg Spacer Pillow does not provide sufficient elevation for both legs of individual needing a higher elevation to obtain the relief provided by the present invention;
(j) the Heel Pillow Mattress is exclusively for bedridden patients and relates to health care intensive care/specialty mattress.

BACKGROUND OF THE INVENTON—OBJECTS AND ADVANTAGES

Accordingly, the several objects and advantages of the present invention are:

(a) to provide a support or pillow to rest and relax an individual lying in a comfortable supine position;
(b) to provide a handy and easy-to-carry, accessible, convenient and ready-to-use pillow;
(c) to provide a therapeutic leg and foot pillow where there is no need to take the user to the hospital, or other healthcare or medical facility;
(d) to provide a support or pillow to bring relief and relaxation to non-patients;
(e) to provide a support or pillow during wakeful hours without the need to go to sleep first;
(f) to provide a support or pillow that is simple to use;
(g) to provide a support or pillow that can be flipped over and used on either side;
(h) to provide a pillow to give relief to legs, especially of women, nurses, office personnel, housewives, housekeepers, etc. after long hours of standing at work, home or shopping, as well as reduce stress and prevent varicose veins by elevating the legs, in addition to exercising, wearing support hose and avoiding high heels.
(i) to provide a pillow that is easily transportable for use at any location including but not limited to homes, office, hotels, hospitals and other medical facilities.
(j) to provide a support which elevates the lower legs and feet to improve blood circulation in the individual's body,
(k) to provide a lower leg and foot pillow which can also be used as a head pillow, neck pillow, knee lift, and upper back pillow;
(l) to provide a devise to relieve pain and pressure on muscles, joints and nerves so that an individual can relax and rest comfortably.
(l) to provide a new device with a new angle of supporting and positioning the lower leg and foot of a reclining person to obtain aforementioned benefits.
(n) to provide a lower leg and foot pillow that can be used for therapeutic purposes. Users of the present invention would realize substantial savings by eliminating the need to purchase medicine.

These, and other objects, advantages and features of the invention will become apparent from the following summary, description, drawings and claims.

SUMMARY OF THE INVENTION

In accordance with the present invention, a lower leg and foot pillow comprises a support elevating both the lower legs and feet of a person in a reclining or lying in a supine position, and having an inner lining or cover and also a removable and changeable pillowcase or cover.

DRAWINGS

Figures

Figure 7A:
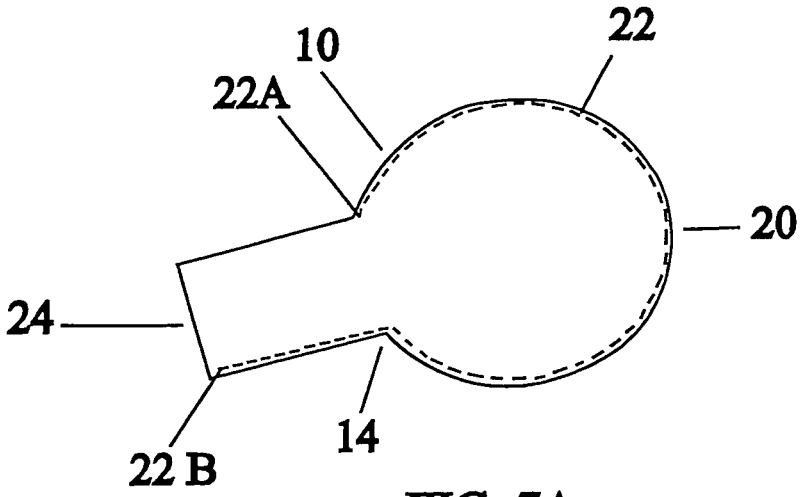

FIG. 7A is the side view or right side of an embodiment of a variation of the invention. The opposite side is a mirror image of this side. The broken lines represent the path of the closure on either side of the embodiment. The reference numeral 10/14 depict use of either of its surfaces.

Figure 7B:
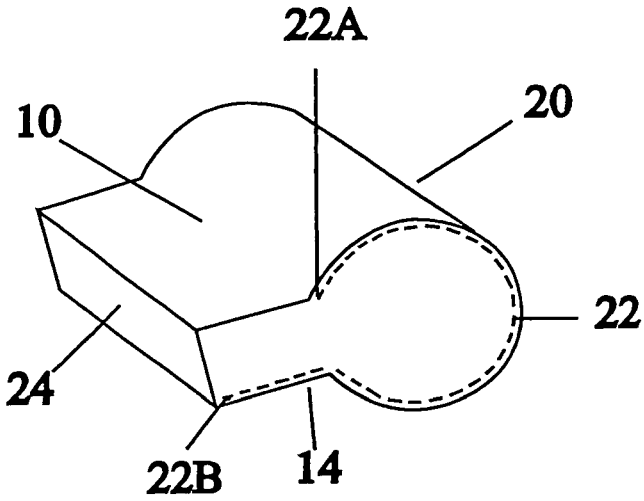

FIG. 7B is the perspective top view of the embodiment depicted in FIG. 7A. The bottom surface is a mirror image of the top surface shown in the figure.

Figure 8A:
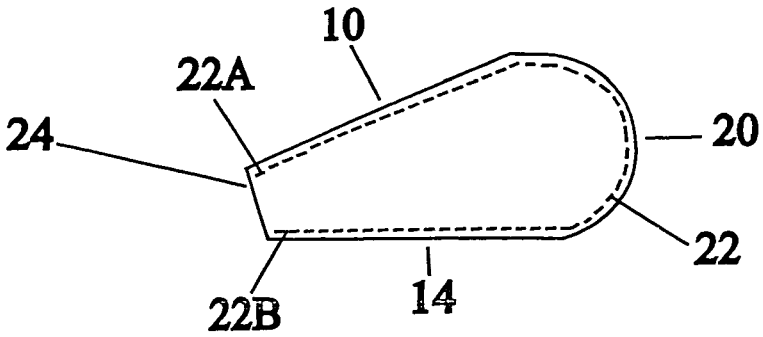

FIG. 8A is the side view of an embodiment of another variation of the invention. The opposite side is a mirror image of that shown. The broken lines represent the path of the closure by any suitable method, like, for example, a zipper beginning from the top of the back end at the west of the drawing and ending at the bottom thereof. The alternative path of zipper or other closure is the middle of the side beginning from the easternmost side, going through the middle of the back end.

Figure 8B:
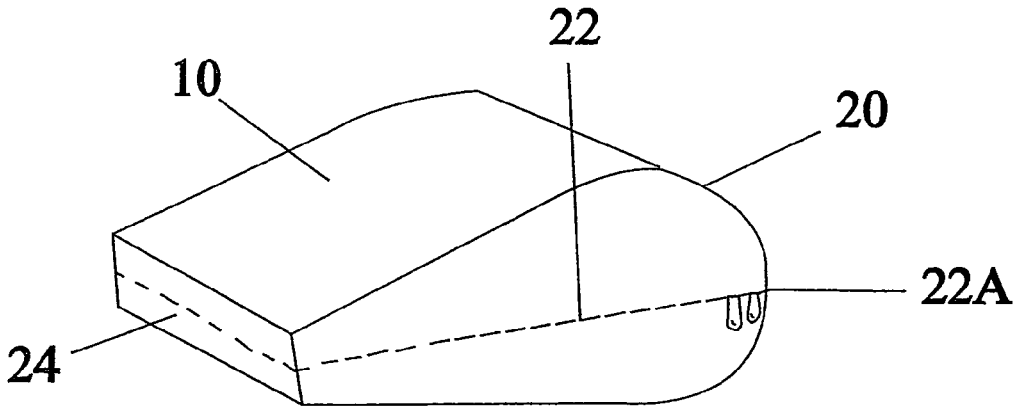

FIG. 8B is the perspective top view of the invention depicted in FIG. 8A. The bottom side is a mirror image of that shown. Either top or bottom surface may be used to elevate the lower legs and feet of the user. The broken lines depicted in the drawing represent an alternative closure route or path along the left side, back end and right side of the embodiment of the invention.

Figure 9A:
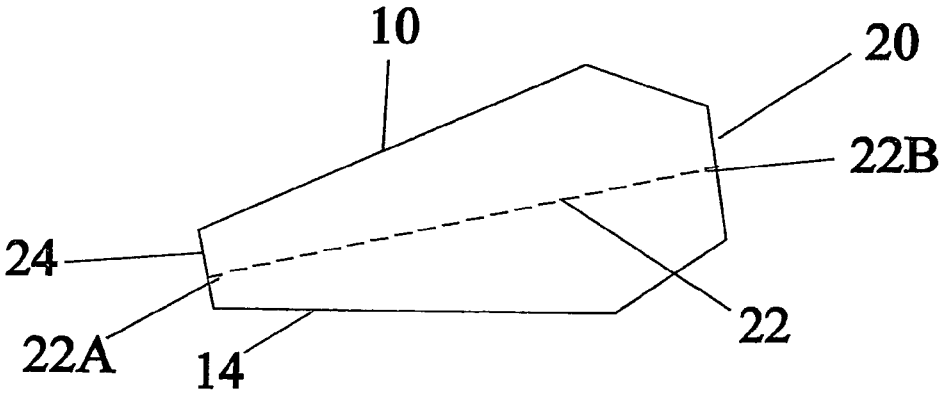

FIG. 9A depicts an embodiment of a variation of the invention showing a rhombus-like front end.

Figure 9B:
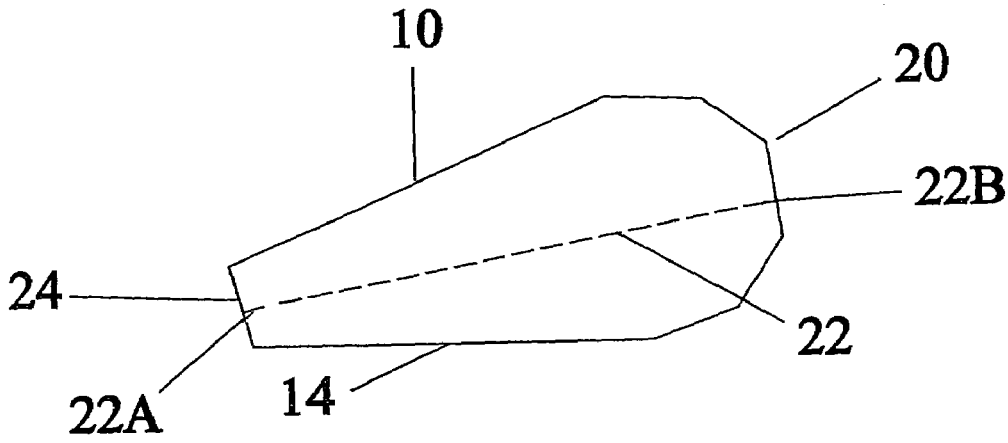

FIG. 9B depicts an embodiment of a variation of the invention with a hexagonal front end.

Figure 1:
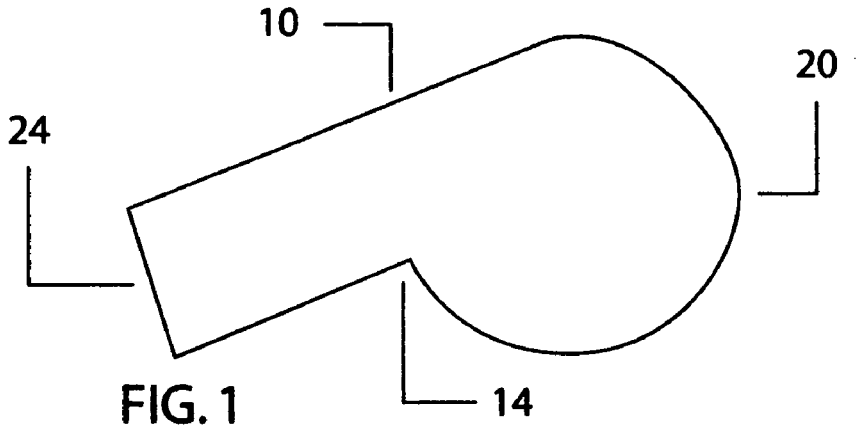
FIG. 1 depicts a perspective view of the right side of an embodiment of this invention. The opposite or left side is a mirror image of this view.
Figure 9C:
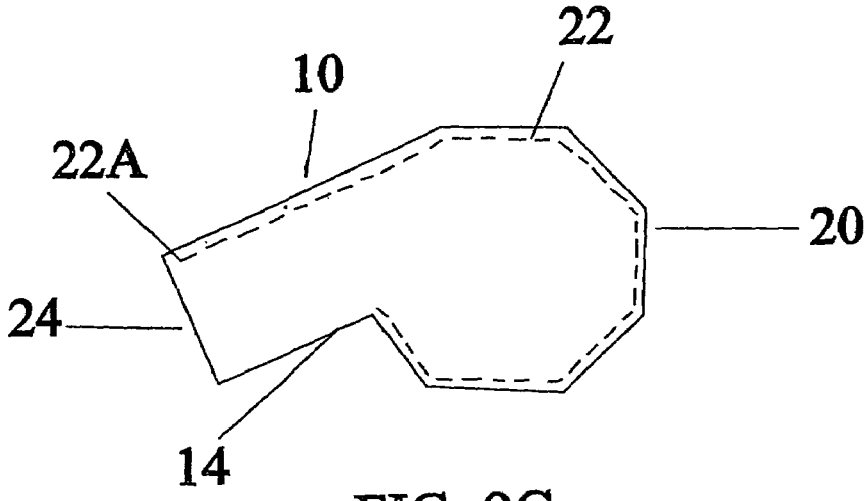

FIG. 9C depicts the embodiment of the invention in FIG. 1 showing a variation comprising a hexagonal front end.

DRAWINGS

Reference Numerals

| | |
|---|---|
| 10 | top surface |
| 14 | bottom surface |
| 20 | front end |
| 22A | start of zipper or other closure path |
| 22 | zipper or other closure path |
| 22B | end of zipper or other closure path |
| 24 | back end |

DETAILED DESCRIPTION OF THE PREFERRED EMBODIMENT AND OPERATION

Before the embodiments of this invention are explained in detail, it is to be understood that the invention is not limited in its application to the details of construction and arrangements of components set forth in the following description or illustrated in the drawings. The invention is capable of other embodiments and of being carried out in other ways. Also, it is to be understood that the phraseology and terminology used herein is for the purpose of description and illustration and should not be regarded as limiting.

Referring now to the drawings, it is seen that the FIG. 1 depicts a sideview or right side or eastern side of an embodiment of the invention (with two covers: first, its inner lining or cover made of cloth or other lining material sewn, zippered, or otherwise done or made to cover the body of the invention, and second, a pillowcase or other material to cover the lining and the body of the invention) in its intended position. The top surface is generally denoted by reference numeral 10, the bottom surface, by reference numeral 14, the front end by the reference numeral 20 and the back end by the reference numeral 24

Figure 2:
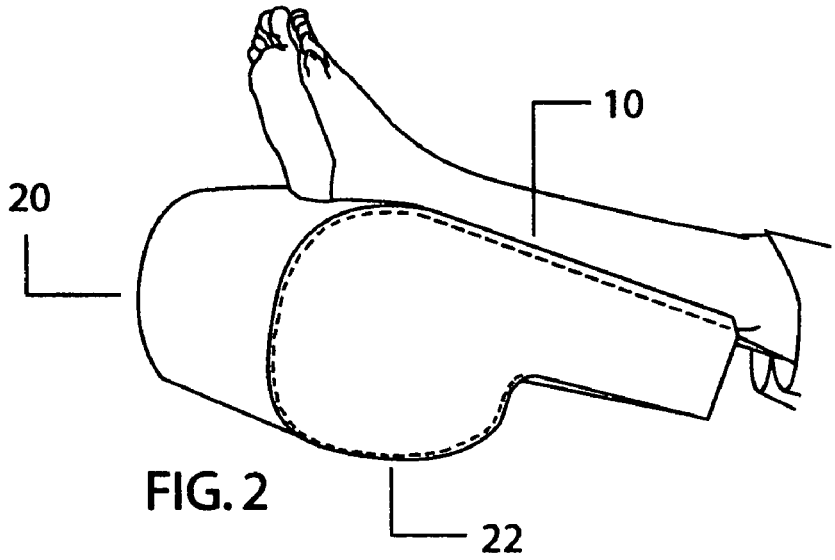
FIG. 2 depicts a perspective or tangential view of the invention complete with inner lining and pillowcase, illustrating how it is used, the position of the lower legs and feet, and the broken lines representing the closure on either side, like, for example, a zipper beginning from the back end and ending at the bottom surface of the invention to close the pillowcase.

FIG. 2 depicts a tangential view of the embodiment of the invention showing top surface 10, bottom surface 14, and front end 20. FIG. 2 also depicts the way it is used by the user with lower legs and feet from the calf and heel of both legs resting on top surface 10. FIG. 2 depicts the dotted lines denoted by reference numeral 22 generally to represent the path, route or contour of the line of the zipper of the pillowcase, with 22-A as the starting point and 22-B as the end point of the zipper or other closure closing the pillowcase with the pillow inside. The pillowcase zipper or other closure material or process is only on one side of the pillow.

Figure 3A:
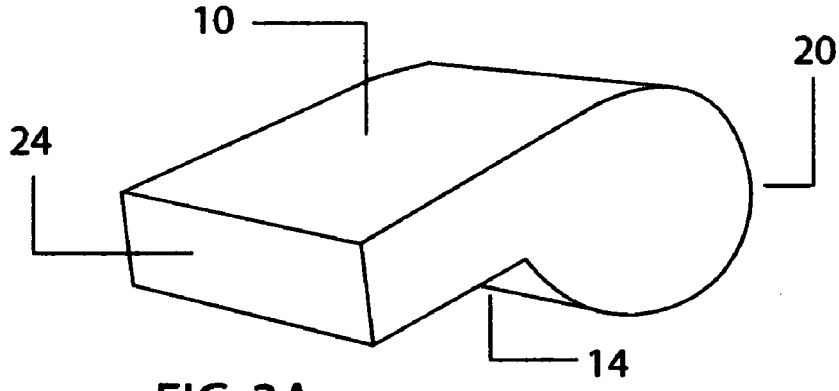
FIG. 3A depicts a perspective top plan view from above looking down at the invention, showing clockwise from the west: the back end, the flat top or dorsal surface, the curving front end sloping to the bottom joined by the flat portion of the bottom of the invention.

FIG. 3A depicts the top surface 10, bottom surface 14, front end 20, and back end 24.

Figure 3B:
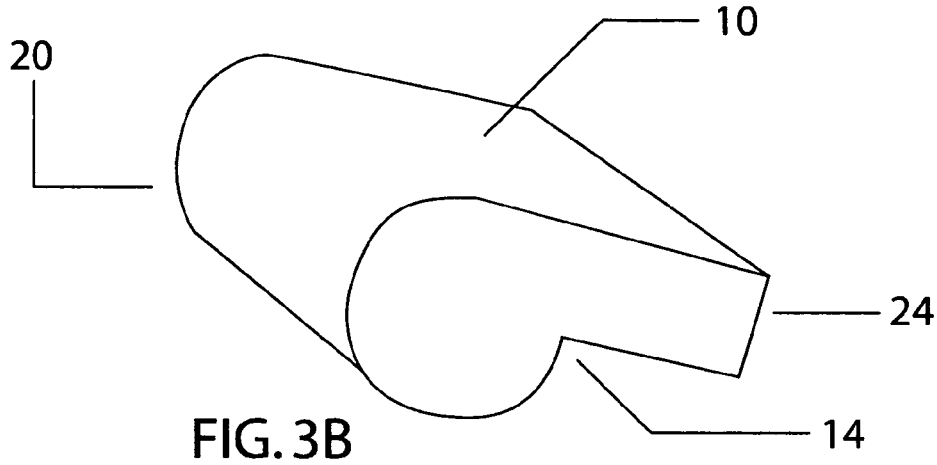
FIG. 3B is a perspective top view from above looking down at the invention, showing clockwise the sloping or curving front end, the flat top surface, the back end, and the left side of the invention.

FIG. 3B depicts the top surface 10, bottom surface 14, front end 20, and back end 24.

Figure 3C:
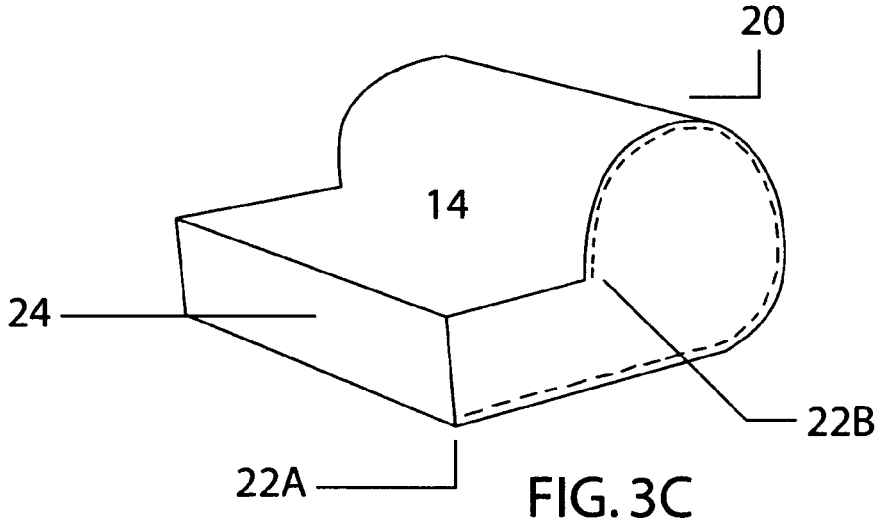
FIG. 3C is a perspective view from above looking down at reverse or flip side of the invention, lying on its back, showing clockwise from the west of the drawing, the back end, and the bottom surface with the flat portion joining the curvature to the front end of the invention east of the drawing.
Figure 3D:
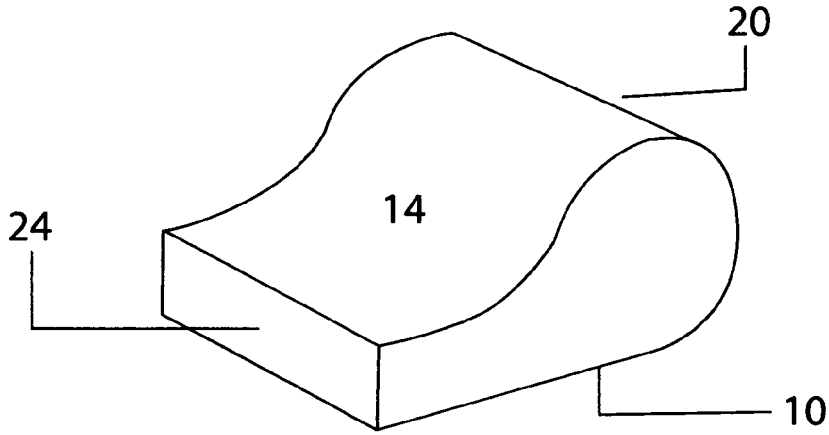
FIG. 3D is a perspective view of a variation of the bottom surface of the embodiment of the invention, depicting a concave surface from the back end going upward to the front end.
Figure 4:
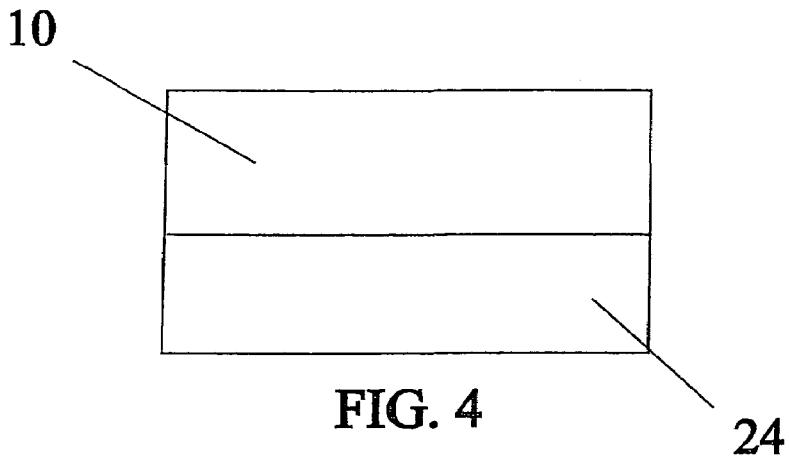
FIG. 4 depicts the back end or back view of the invention either in its upright position or supine position.
Figure 5:
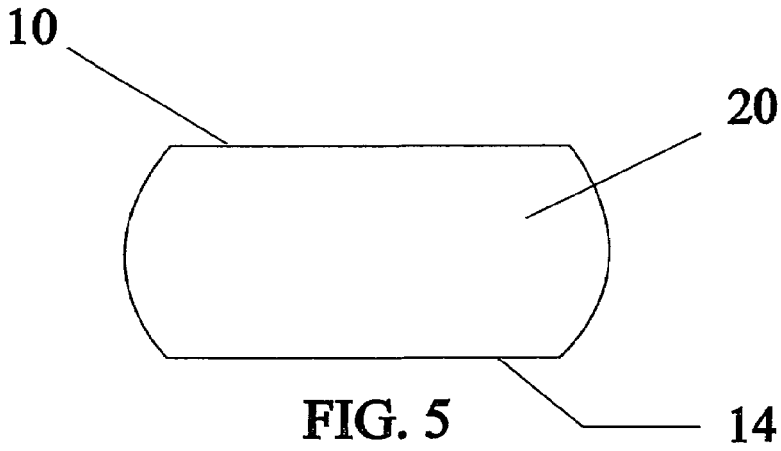
FIG. 5 depicts a panoramic view of the front end of the invention, which is cylinder-like or a curvature for illustration.
Figure 6:
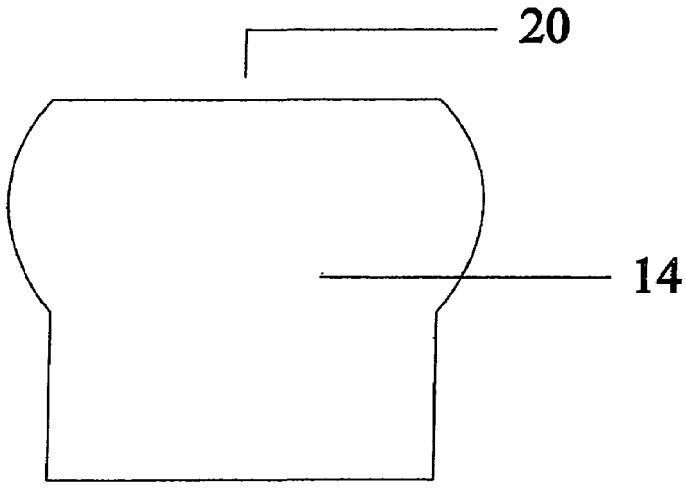
FIG. 6 depicts a panoramic view of the bottom surface or side perspective of the invention, which is also the flipside of the use of the invention.

FIG. 3C depicts the pillow when flipped over to show that the bottom surface of the pillow can be used on which to rest the calf (at the back end 24) and heel (at the front end) of both legs of the user.

DESCRIPTION—ADDITIONAL OR ALTERNATIVE EMBODIMENTS AND OPERATION

FIGS. 7B, 8A (broken lines depicting the route of the zipper or other closure on only one side of the pillow), and 8B are additional embodiments that the present invention is capable of. The user's lower legs and feet are placed in the manner similar to the way depicted in FIG. 2. FIGS. 9A, 9B and 9C depict alternative non-circular embodiments of the front end 20 the invention.

Aside from a flat top surface 10, flat portion of the bottom surface 14, flat back end 24 and flat left and right sides of the invention, an alternative embodiment may have a corrugated or other non-flat surface for such surfaces and sides.

CONCLUSION, RAMIFICATIONS AND SCOPE

The device constructed in accordance with the present invention may be used advantageously to provide therapy, relaxation and relief from physical and mental stress, strain, tension, fatigue from standing, working, shopping or otherwise being active for long hours, by using it while the user is conveniently at home, or in a sofa or other place in the office or any other place where the user can place his or her lower legs and feet on the pillow and lie down supinely. The benefit comes from the user placing both lower legs and feet on the top surface of the invention and resting his or her body on the surface of a bed, sofa, carpeted floor or other flat or similar surface. After a few minutes, the work is done! This simple, self-help relief thus would improve blood circulation, reduce physical and mental stress from tension, strain, travel, and long hours of standing at work, home or walking, shopping, or other physical activity involving the legs, and also helps prevent varicose veins. This invention is for young and old adults and not necessarily for patients only. The unique form and structure of the invention contributes to the benefits accruing from its use. Made of foam or other material of compact or solid mass with resiliency to permit its insertion into an inner line or cover and an outer covering like a pillowcase or other cover, it is shaped by a factory computerized cutter.

The use of the invention is simple. It is light and portable and thus can be used anywhere where the user can lie down supinely. The user needs only to place both lower legs from the calf up to the heel on the top surface of the invention and lie down on his or her back for short durations of time like twenty minutes rather than extended periods. Although the curving, or circular front end of the invention extends to the bottom surface, like the letter "P" in prone position, this invention can be flipped over and used in the same manner for the aforementioned benefits.

While the pillow may be made from other resilient material or made of inflatable material, the best mode of the invention is to form the invention of firm but resilient foam, because the foam retains better shape, which allows proper retention of the pillow and its use for a long period of time.

The invention admits of other forms, configurations, and variations shown in the drawings. Capable of multipurpose use, it can be used in other ways like a head and upper back pillow while watching TV or cable video or resting or otherwise resting, or in hospitals or other healthcare facilities for patients' relief and relaxation during the healing process.

Although the description above contains many specificities, these should not be construed as limiting the scope of the invention, but as merely providing illustrations of some of the presently preferred embodiments of this invention. For example, the profile of the front end from the top surface (extending down to the bottom surface of the embodiment resempling "P" in prone position of the invention) can have other shapes, such as oval, rhombus-like, hexagonal, octagonal, rectangular or square-like. On the other hand, the sides and/or surfaces of the invention need not be flat but may assume other forms such as corrugated or other surface shapes common to bed mattresses. Those skilled in the art will appreciate that various adaptations and modifications of the just described invention can be configured without departing from the scope and spirit of the invention. Accordingly, the scope of the invention should be determined not by the embodiments illustrated but by the spirit of the invention, and the appended claims and their legal equivalents.

We claim:

1. A pillow for relieving leg fatigue, improving blood circulation and helping prevent abnormally swollen or dilated veins of the of a user, comprising:

a body with a cross section which approximately resembles the letter P of the alphabet in prone position;

a substantially flat top surface of said body with an area of sufficient size to underlie the posterior portions of the lower legs and feet, from the calves to the heels, of the user while in a supine position;

a bottom surface of said body with an area of the same size of said top surface;

an approximately curved front end of said body which substantially turns downward circumferentially from said top surface at the front end of said body to said bottom surface;

back end of said body which vertically joins said top surface and said bottom surface;

an inner overlay made of a material capable of being made to serve as a lining of said body;

a removable and replaceable outer overlay substantially like a pillowcase of a material capable of being made to cover said body and said inner overlay;

and a said body made of spongy or resilient material, whereby said pillow is positionable under the calves and heels of the lower legs, lying side by side, of the user in a supine position so that said top surface or upper surface upwardly underlies said lower legs beginning from said calves towards the heels.

2. A The pillow of claim 1, further comprising the top surface of the pillow being in a slanting position from the back end upward to the front end to allow or permit the user to place or rest both of the user's lower legs thereon while the user is in a supine position with the anterior portion of the leg and foot from the calf to the heel being placed on the pillow.

3. A pillow or support as recited in claim 1 further comprising a bottom portion or surface at the front end serving as a pillar for the weight of the legs and feet, and for adequate elevation of the legs and feet, and further which bottom surface can be inverted thereby permitting a flipside use of the pillow for the same object and advantage.

4. A The pillow of claim 1 further comprising said outer cover comprises a removable and changeable pillowcase, cover or encasing made of material capable of being made and structured to cover said pillow, which pillowcase, cover or encasing may be closed with a closure to close the pillowcase, cover or encasing, and which pillowcase, cover or encasing may be plain, quilted, with ruffles or otherwise decorated.

5. The pillow of claim 1, further wherein said pillow can use a cross section that is rectangular, square-like hexagonal, rhombus-like, or octagonal.

* * * * *